United States Patent [19]

Fisherman et al.

[11] Patent Number: 4,680,681

[45] Date of Patent: Jul. 14, 1987

[54] INTEGRAL BOOK COVER AND READING LIGHT

[75] Inventors: Carl Fisherman, Franklin Lakes, N.J.; Eric Beare, Kowloon, Hong Kong

[73] Assignee: Photo Audio Consumer Electronics Marketing Corporation, New York, N.Y.

[21] Appl. No.: 882,725

[22] Filed: Jul. 7, 1986

[51] Int. Cl.[4] ..... A47B 19/00

[52] U.S. Cl. ..... 362/98; 362/99; 362/155; 362/371; 362/802; 281/19 A; 281/19 R

[58] Field of Search ..... 362/97, 98, 127, 99, 362/155, 156, 371, 802; 40/152.2, 341; 281/29, 19 R, 19 A, 36

[56] References Cited

U.S. PATENT DOCUMENTS

| | | | |
|---|---|---|---|
| 1,202,498 | 10/1916 | Findley | 362/99 |
| 2,561,744 | 7/1951 | Langdon et al. | 362/98 X |
| 3,364,344 | 1/1968 | Marcellino | 362/99 |
| 3,500,034 | 3/1970 | Bissell | 362/98 |
| 3,823,312 | 7/1974 | Weinstein | 362/99 |
| 4,290,093 | 9/1981 | Thompson et al. | 362/98 |
| 4,432,042 | 2/1984 | Zeller | 362/98 X |
| 4,598,340 | 7/1986 | Dwosh et al. | 362/98 |

FOREIGN PATENT DOCUMENTS

| | | | |
|---|---|---|---|
| 197870 | 5/1938 | Switzerland | 281/19 A |
| 256849 | 8/1926 | United Kingdom | 362/98 |

*Primary Examiner*—Larry Jones
*Attorney, Agent, or Firm*—Ezra Sutton

[57] ABSTRACT

The present invention relates to an integral book cover and reading light and is directed to a simple, inexpensive, compact, and portable device for reading which will not disturb others and at the same time provides privacy, if required, as to the title of the book being read.

10 Claims, 9 Drawing Figures

INTEGRAL BOOK COVER AND READING LIGHT

FIELD OF THE INVENTION

The present invention relates to an integral book cover and reading light and, more particularly, is directed to a simple, inexpensive, compact, and portable device for reading which will not disturb others and at the same time provides privacy, if required, as to the title of the book being read.

BACKGROUND OF THE INVENTION

The prior art discloses the use of book covers in combination with reading lights. In some examples, such as U.S. Pat. No. 3,364,344, the reading light and batteries are not housed in the same container, and thus, such an arrangement does not provide a compact and attractive unit. In other examples, such as U.S. Pat. No. 1,202,498 and 3,823,312, a container is mounted on the spine of the book cover to house the batteries. However, in such arrangements, the reading light is disposed outside of the battery container and cannot be stored when not in use. Thus, such arrangements are not compact, are inconvenient to use and store, and are not easily portable.

Broadly, it is an object of the present invention to provide an improved combination of a book cover and reading light which overcomes the aforesaid drawbacks of the prior art. Specifically, it is within the contemplation of the present invention to provide an improved device which is simple to use and store, inexpensive, convenient, compact, and portable, and which accommodates all types of books, including paperbacks and hard cover books, as well as books of different sizes and thicknesses.

It is a further object of the present invention to provide an improved combination of a book cover and reading light which is combined into a compact and portable arrangement but yet allows the reading light to be extended over the left-hand page of the book or the right-hand page of the book, so that the user can more easily focus the light where desired.

It is a still further object of the present invention to provide an improved arrangement which is easy to use and which is easy to store, since the operation of extending the reading light out of the battery container automatically operates to turn on the reading light, and storage is easily accomplished, since it is only necessary to return the reading light to the battery compartment which automatically turns off the reading light.

SUMMARY OF THE INVENTION

Briefly, in accordance with the principles of the present invention, there is provided an improved integral book cover and reading light which includes a book cover having a central spine section and two outer covers each pivotally connected to opposite edges of the central spine section. An elongated housing is mounted on the central spine section and includes a first compartment for receiving batteries arranged in parallel to a second compartment for receiving a supporting arm for a reading light. The supporting arm and reading light are disposed for movement relative to the second compartment between an open position in which the supporting arm extends out of the second compartment and a closed position in which the supporting arm is disposed within the second compartment. In addition, the reading light is movably mounted relative to the supporting arm for directing light in different directions, as desired by the user.

In the preferred embodiment, the reading light includes a reflector, and the reflector forms the upper portion of the housing, so that in the closed position, the reflector functions as a closure to close off one end of the housing and the first and second compartments.

In addition, in the preferred embodiment, metal contacts are provided on the inside of the housing, and on the lower end of the supporting arm. In this manner, when the supporting arm is moved to its closed position, the contacts are disengaged, and the reading light is automatically turned off, and the device is ready for transport or storage. To operate, the supporting arm is moved out of the housing to its extended position, and the contacts on the supporting arm come into engagement with the contacts on the housing to automatically turn on the reading light and render the device ready for use.

Advantageously, as a result of the invention, there is provided an improved device which is easy to use and easy to store. The simple operation of extending the supporting arm and reading light renders the device ready for use, and the simple operation of retracting the supporting arm into the housing turns off the light and renders the device ready for storage.

BRIEF DESCRIPTION OF THE DRAWINGS

Further objects, features, and advantages of the present invention will become apparent upon the consideration of the detailed description of the presently-preferred embodiment when taken in conjunction with the accompanying drawings, wherein.

DETAILED DESCRIPTION OF THE PREFERRED EMBODIMENTS

Figure 1:
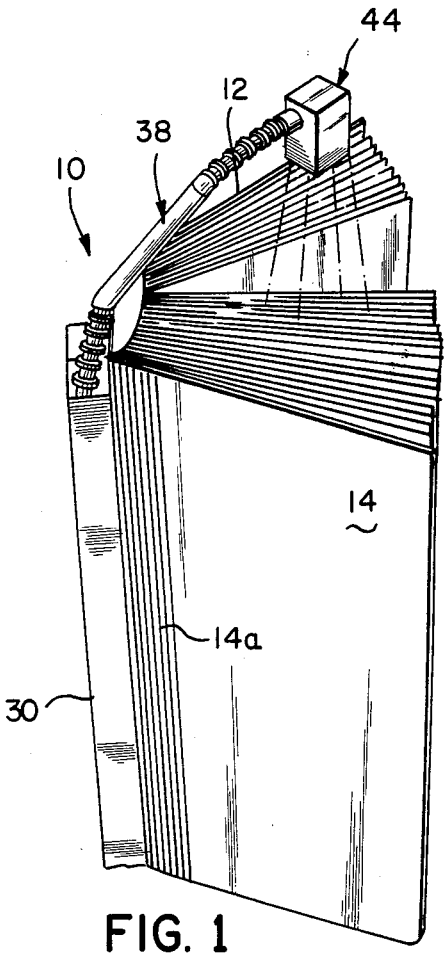
FIG. 1 is a perspective view of the integral book cover and reading light illustrating the reading light and supporting arm in its extended position.
Figure 2:
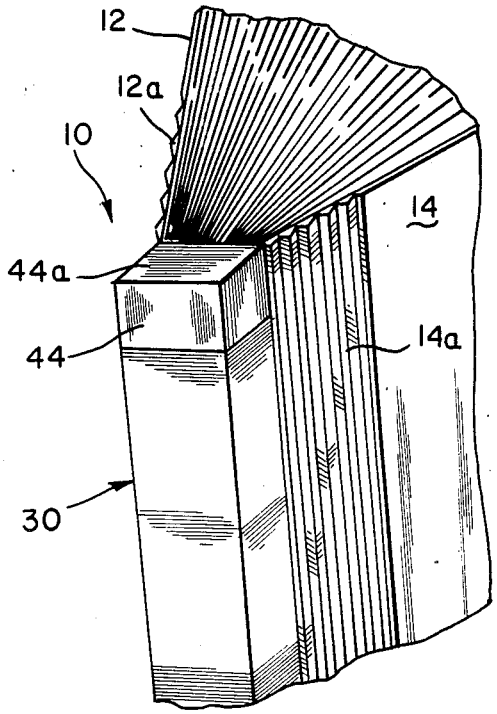
FIG. 2 is a partial perspective view illustrating the supporting arm in its retracted or closed position with the reflector housing closing off the upper end of the battery housing and protecting the bulb from damage when not in use.
Figure 3:
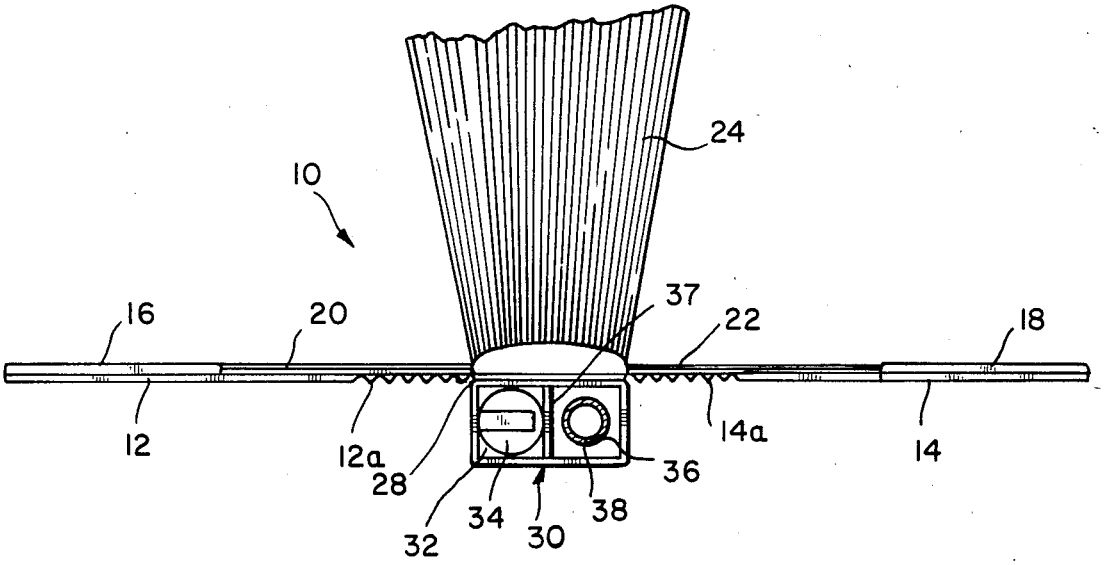
FIG. 3 is a plan view of the book cover in its open position looking into both compartments of the battery housing.

Referring now to FIGS. 1 to 3, there is illustrated the integral book cover and reading light in accordance with the present invention, designated by the reference numeral 10, which includes book covers 12 and 14 (shown most clearly in FIG. 3), each having respective inner pockets 16 and 18 for receiving the covers 20 and 22 of a book having pages 24. It should be understood that the book cover and reading light 10 of the present invention may be used with a book of any type, including paperbacks or hard cover books, and in addition, the book cover 10 of the present invention can be made to accommodate books of any size and of any thickness.

In the preferred embodiment, the covers 12 and 14 of the book cover may be made of any suitable flexible material, such as vinyl, plastic, or leather. Alternatively, the covers 12 and 14 can be made out of any suitable rigid material, and can be made with or without pockets 16, 18. In addition, the covers 12, 14 may be scored or corrugated, as shown as 12a and 14a, in order to allow the book cover to fold more easily and accommodate books of different thicknesses.

Figure 7:
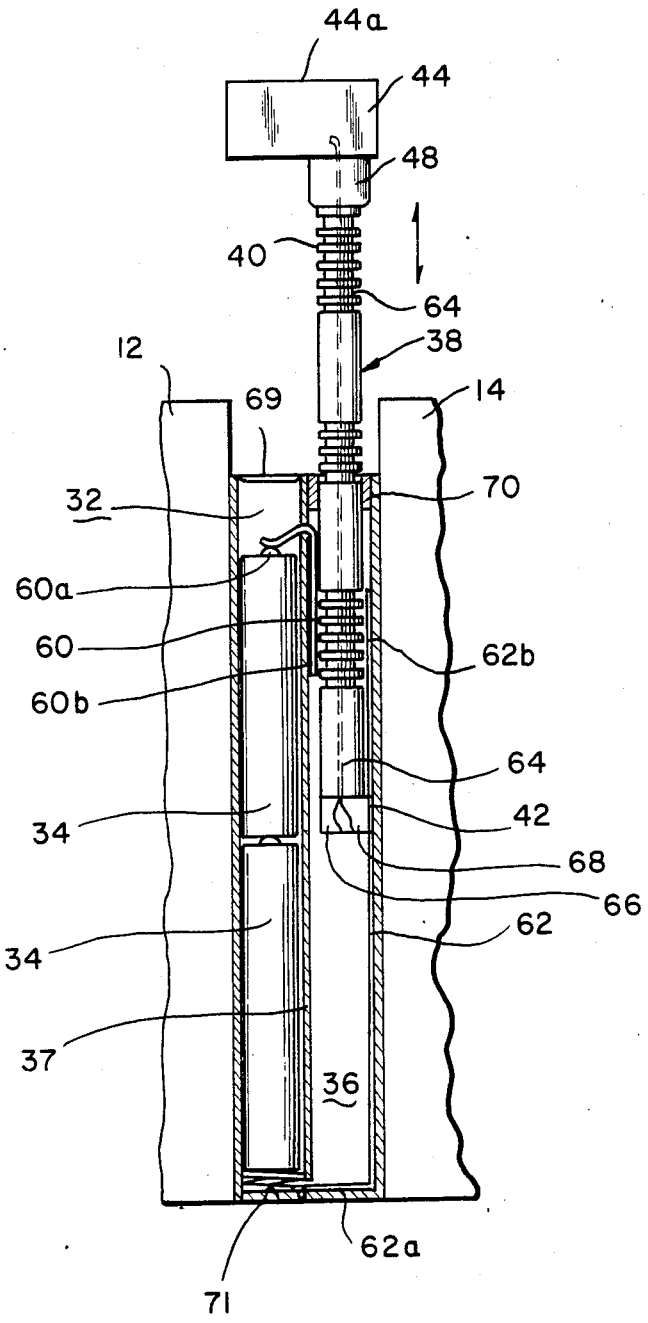
FIG. 7 is a detailed elevational view of the battery compartment with the supporting arm and reading light extended.

The integral book cover and reading light 10 of the present invention also includes a spine section 28 on which is mounted an elongated housing 30 made of any suitable material, such as plastic. The housing 30 includes a first compartment 32 for receiving batteries 34, a second compartment 36 for receiving a supporting arm 38, a wall 37 separating the two compartments, and a reflector housing 44, for a purpose to be explained. As will be noted, compartments 32 and 36 are rectangular in cross section, but can be of any suitable configuration, such as semicircular. As shown in FIG. 7, compartment 32 is closed at the top by a cap 69 and is openable at the bottom by a door 71 for changing batteries 34. Compartment 36 includes a collar member 70 at its top through which arm 38 moves in and out of the compartment.

Figure 4:
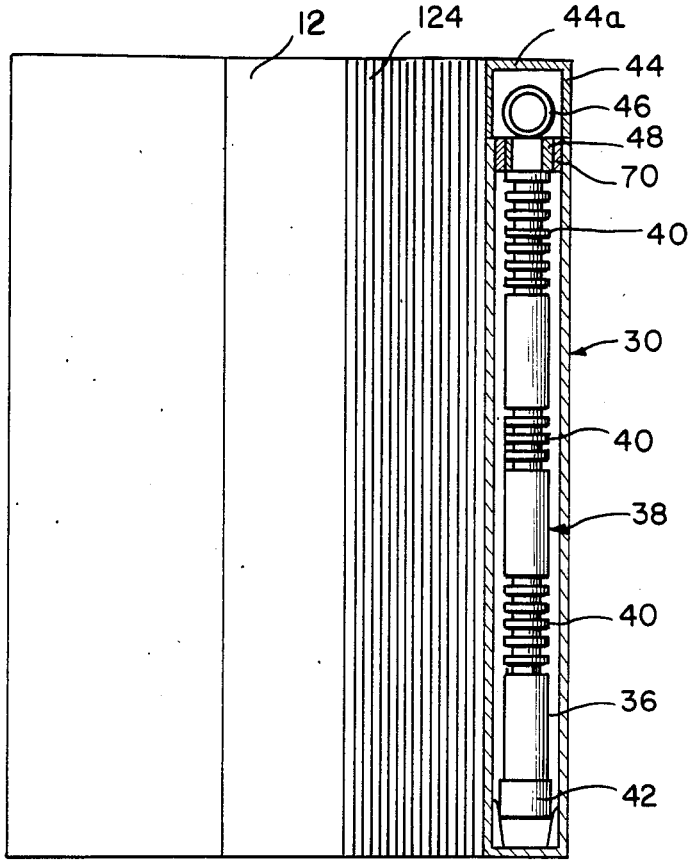
FIG. 4 is an elevational view which illustrates one of the covers of the book cover and the battery housing with the supporting arm in its retracted or closed position.

As shown in FIG. 4, the supporting arm 38 includes sections 40 which are flexible and bendable, so that the arm can be moved or adjusted to any desired position over the book. Arm 38 also includes a stop member 42 at the lower end of the arm for engaging collar member 70 to limit how far arm 38 may be extended. The reflector housing 44 is connected to the upper end of the arm and encloses a light bulb 46. In this manner, the reflector housing 44 concentrates the light from light bulb 46 downwardly towards the pages of the book. The supporting arm 38 and reflector 44 are disposed for movement relative to compartment 36 between an open position (shown in FIGS. 5, 6, and 7) in which the supporting arm 38 extends out of the compartment 36, and a close position (shown in FIG. 4) in which the supporting arm 38 is completely disposed within the compartment 36. In addition, the reflector housing 44 is pivotally mounted by collar 48 on supporting arm 38 for pivoting reflector housing 44 and light bulb 46 in different directions, as desired during use.

Figure 5:
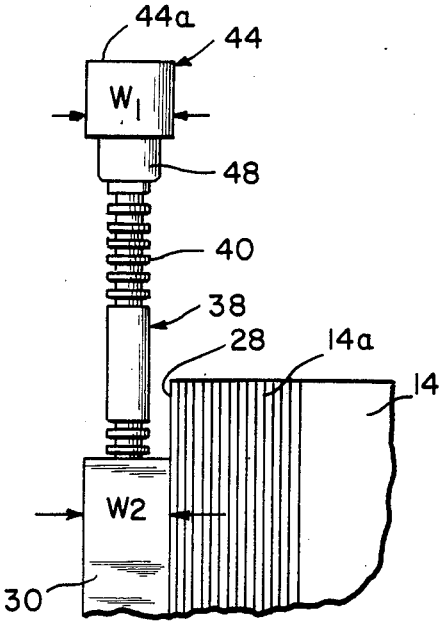
FIG. 5 is a partial side elevational view showing the supporting arm and reading light partially extended.
Figure 6:
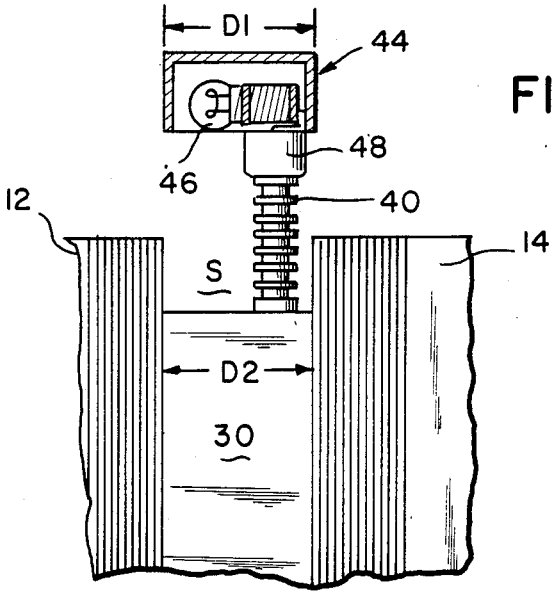
FIG. 6 is a partial rear elevational view showing the supporting arm and reading light partially extended.

As shown in FIGS. 5, 6, and 7, the compartments 32 and 36 are slightly shorter than the adjacent book covers 12 and 14. Thus, the top surface of compartments 32 and 36, together with spine section 28, define a space S adapted to receive reflector housing 44 when it is moved into its closed position to close off the upper ends of compartments 32 and 36 and to close housing 30, so that the device may be easily and compactly stored. In addition, as shown in FIG. 4, the top surface 44a of the reflector housing, in its closed position, is coplanar with or coextensive with the top surfaces of book covers 12 and 14. Further, not only is the height of space S equal to the height of reflector housing 44, but as shown in FIG. 5, the width W1 of reflector housing 44 is also equal to the width W2 of housing 30. Further, as shown in FIG. 6, the depth D1 of surface 44b of reflector housing 44 is equal to the depth D2 of housing 30. Accordingly, in this manner, when reflector housing 44 is moved to its closed position, it forms a part of the elongated housing 30 and functions as a closure to close off the open end of compartment 36 and also protects bulb 46 from damage when not in use.

Referring to FIG. 7, there is shown the automatic switching arrangement of the present invention. More particularly, battery compartment 32 includes a metal contact 60 mounted at its upper end, which extends into compartment 36 and includes one end **60*a* for contact with batteries 34 and a second end 60*b* for contact with elongated arm 38, in a manner to be explained. In addition, housing 30 includes an elongated L-shaped metal contact 62 disposed therein which has one end 62*a* connected to the bottom of batteries 34 and an upper end 62*b* for contact with arm 38, in a manner to be explained. Arm 38 houses an electrical wire 64 connected to light bulb 46 and which extends down through the length of supporting arm 38 to metal contacts 66 and 68 mounted on stop member 42. As supporting arm 38 moves in and out relative to compartment 36, metal contact 68 always remains in engagement with metal contact 62. Thus, it is only when metal contact 66 is brought into engagement with metal contact 60*b* that the electrical circuit is completed and operates to turn on light bulb 46. This occurs when supporting arm 38 is moved in an upward direction within compartment 36 to its extended position. Arm 38 is prevented from being removed from compartment 36 by stop member 42 engaging collar 70 disposed at the top of compartment 36. When the arm 38 is retracted into compartment 36, and reflector housing 44 is disposed within space S to close housing 30, the electrical contact between contact 66 and 60*b*** is broken, and the light is automatically turned off.

Thus, in accordance with the present invention, the simple step of extending or retracting the supporting arm 38 operates to automatically turn on or off the light bulb 46. It is simple and convenient for the user to move the device to its operating position for use or to move the device to its closed position for storage and transport. In addition, a compact and portable arrangement is provided when housing 44 is moved to its closed position. It is only necessary to make sure the reflector housing 44 is turned 90° when moved to its closed position to line up with housing 30. Further, since arm 38 is flexible and bendable, when it is in the extended position, the light bulb 46 can be adjusted to focus on the left-hand page or right-hand page of the book, or merely be held in a center position between the two pages. Still further, since reflector housing 44 is rotatable or pivotable relative to arm 38, this further enhances the capability of directing light as desired by the user. As a further advantage, when the reflector housing is in its closed position, the light bulb 46 is completely enclosed and protected and thus is not susceptible to being damaged.

Figure 8:
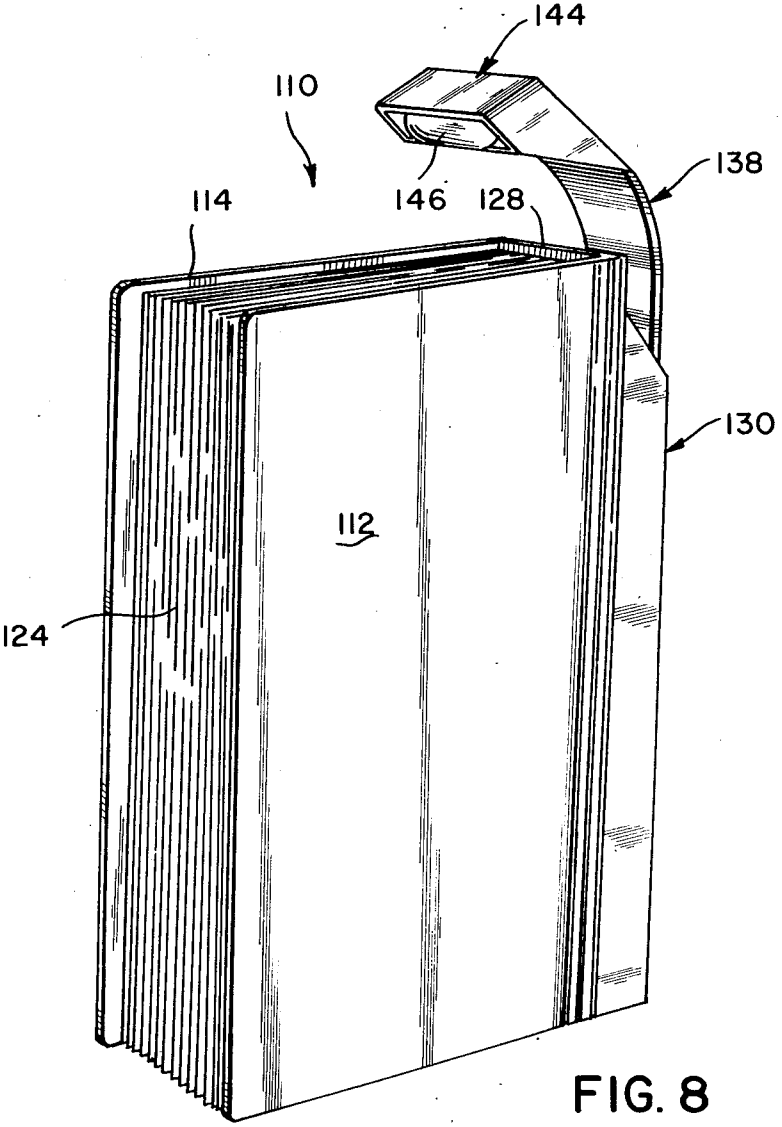
FIG. 8 is an alternative embodiment of the present invention.

Referring now to FIG. 8, there is shown an alternative embodiment 110 of the present invention having book covers 112 and 114 and a housing 130 for housing batteries therein. An extendable and bendable arm 138 is provided which is movable into and out of housing 130, similar to the manner of arm 38. In addition, the embodiment shown in FIG. 8 includes a reflector housing 144 having a light bulb 146. As will be understood, the operation of this embodiment is similar to the embodiment shown in FIGS. 1 to 7. More particularly, the movment of arm 138 to its closed position operates to enclose and protect light bulb 146 and also operates to disengage electrical contacts and turn off bulb 146. Similarly, when arm 138 is extended, electrical contact is made with the batteries to complete the electrical circuit and turn on bulb 146. In addition, since arm 138 is flexible and bendable, the light can be focused in any desired direction relative to the book. In addition, reflector housing 144 is bendable relative to arm 138 to further adjust the direction of light.

Figure 9:
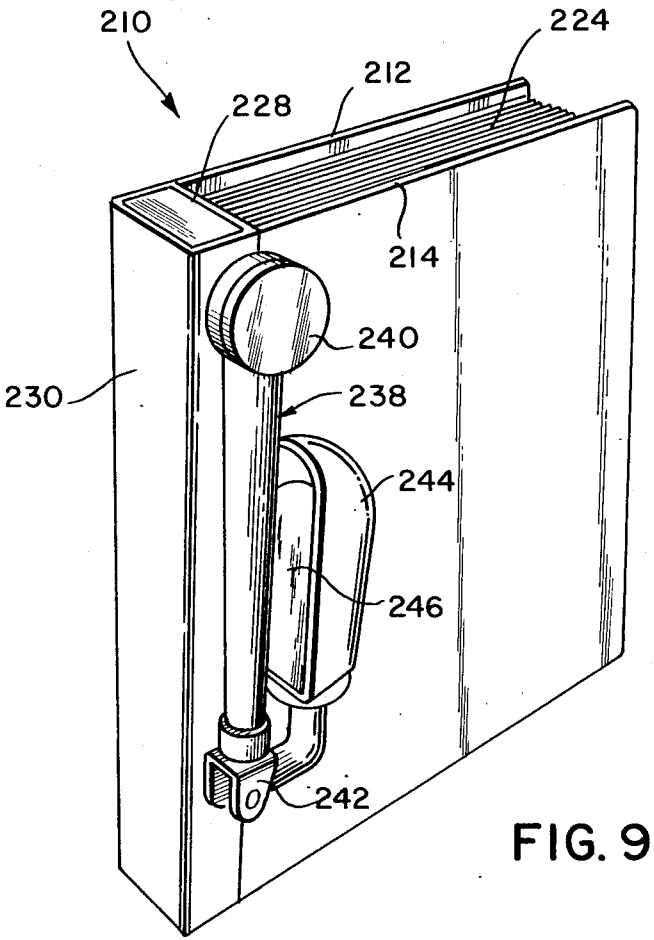
FIG. 9 is another alternative embodiment of the present invention.

Turning now to FIG. 9, there is shown another alternative embodiment 210 of the present invention. As shown therein, there is an elongated battery housing 230 mounted on the spine 228 of the book cover for housing the batteries. In this embodiment, the supporting arm 238 is pivotally mounted at 240 on the outside of housing 230 and includes a reflector housing 244 and a light bulb 246. In addition, in order to adjust the direction of light, there is a pivot connection 242 between reflector housing 244 and supporting arm 238. In this embodiment, electrical contact with the batteries within housing 230 is made by electrical wires extending from the battery housing 230 through the arm 238 and connected to light bulb 246.

Advantageously, as a result of the various embodiments of the present invention, there has been provided an improved integral book cover and reading light which is simple to use, inexpensive, compact, portable, and safe.

A latitude of modification, change, and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein.

What is claimed is:

1. A book cover and reading light comprising;

a book cover having a central spine section, and two outer covers each pivotally connected to opposite edges of said central spine section;

an elongated housing mounted on said central spine section and including a first compartment for receiving batteries and a second compartment for receiving a supporting arm for a reading light;

said supporting arm being disposed for movement relative to said second compartment between an open position in which said supporting arm extends out of said second compartment and a closed position in which said supporting arm is disposed within said second compartment; and said reading light being movably mounted relative to said supporting arm for directing light in different directions.

2. The book cover and reading light in accordance with claim 1, wherein said reading light includes a reflector and wherein said reflector forms a part of said housing.

3. The book cover and reading light in accordance with claim 2, wherein said reflector in the closed position functions as a closure to close one end of said housing and also functions to turn off said reading light automatically.

4. A book cover and reading light in accordance with claim 1, wherein said first compartment and said second compartment are arranged in parallel relative to each other in said housing, said second compartment being of sufficient length to completely receive said supporting arm within said second compartment when said supporting arm is moved to said closed position.

5. A book cover and reading light in accordance with claim 1, wherein said first and second compartments are shorter in length than said two outer covers, and said reflector, in said closed position, closes off said compartments.

6. A book cover and reading light in accordance with claim 5, wherein the top surface of said reflector, in said closed position, is substantially coplanar with the top edges of said two outer covers.

7. A book cover and reading light in accordance with claim 1, wherein said supporting arm is collapsed telescopically.

8. A book cover and reading light in accordance with claim 1, wherein said supporting arm is flexible and bendable.

9. A book cover and reading light in accordance with claim 1 further including switching means for automatically turning said reading light on and off.

10. A book cover and reading light in accordance with claim 9, wherein said switching means includes a first contact on said supporting arm and a second contact in said housing, said first contact being moved out of engagement with said second contact when said supporting arm is moved to said closed position to turn off said light, and said first contact being moved into engagement with said second contact when said supporting arm is moved to said open position to turn on said light.

* * * * *